US008720365B2

(12) United States Patent
Cheng et al.

(10) Patent No.: US 8,720,365 B2
(45) Date of Patent: May 13, 2014

(54) METHOD FOR FABRICATING DISPLAYS, AND APPARATUS AND PROCESS FOR PRODUCING DISPLAYS

(75) Inventors: Chao-Kai Cheng, Miaoli County (TW); Wan-Wen Chiu, Hsinchu County (TW); Yuh-Zheng Lee, Hsinchu (TW); Yuan-Chang Liao, Yunlin County (TW); Jyh-Wen Shiu, Hsinchu County (TW); Jen-Chieh Yang, Changhua County (TW)

(73) Assignee: Industrial Technology Research Institute, Hsinchu (TW)

( * ) Notice: Subject to any disclaimer, the term of this patent is extended or adjusted under 35 U.S.C. 154(b) by 1030 days.

(21) Appl. No.: 12/236,913

(22) Filed: Sep. 24, 2008

(65) Prior Publication Data

US 2009/0227171 A1 Sep. 10, 2009

(30) Foreign Application Priority Data

Mar. 10, 2008 (TW) ..... 97108280 A

(51) Int. Cl.
*B05C 1/00* (2006.01)
*C23C 20/00* (2006.01)

(52) U.S. Cl.
USPC ..... 118/212; 427/96.2

(58) Field of Classification Search
None
See application file for complete search history.

(56) References Cited

U.S. PATENT DOCUMENTS

| | | | | |
|---|---|---|---|---|
| 4,973,373 | A | 11/1990 | Hashimoto et al. | |
| 5,177,841 | A * | 1/1993 | Hamuro et al. | 29/25.42 |
| 5,330,602 | A * | 7/1994 | Leach | 156/283 |
| 5,943,113 | A | 8/1999 | Ichihashi | |
| 6,118,502 | A * | 9/2000 | Yamazaki et al. | 349/45 |
| 7,081,180 | B2 | 7/2006 | Chen et al. | |
| 2004/0169809 | A1 * | 9/2004 | Yamabuchi et al. | 349/153 |
| 2005/0018116 | A1 * | 1/2005 | Ishizuka et al. | 349/117 |
| 2005/0077416 | A1 * | 4/2005 | Heikaus | 242/533.4 |
| 2006/0139529 | A1 * | 6/2006 | Jeng et al. | 349/114 |

FOREIGN PATENT DOCUMENTS

| | | |
|---|---|---|
| TW | 200728816 | 8/2007 |
| TW | 200743847 | 12/2007 |

OTHER PUBLICATIONS

Taiwan Patent Office, Office Action, Application Serial No. 097108280, Apr. 26, 2012, Taiwan.
Taiwan Patent Office, Office Action, Patent Application Serial No. 097108280, Dec. 5, 2012, Taiwan.

* cited by examiner

*Primary Examiner* — Dah-Wei Yuan
*Assistant Examiner* — Charles Capozzi

(57) ABSTRACT

A method for fabricating a display is provided. The method includes providing a substrate having a pixel area, forming a plurality of patterned first electrodes on the pixel area, forming a plurality of partitions on both sides of the patterned first electrodes, respectively filling in spaces between the partitions with various colored material to cover the patterned first electrodes by a depositing process, and forming a cover on the partitions and the colored materials.

14 Claims, 8 Drawing Sheets

METHOD FOR FABRICATING DISPLAYS, AND APPARATUS AND PROCESS FOR PRODUCING DISPLAYS

This Application claims priority of Taiwan Patent Application No. 097108280, filed on Mar. 10, 2008, the entirety of which is incorporated by reference herein.

BACKGROUND OF THE INVENTION

1. Field of the Invention

The invention relates to a method for fabricating a display, and more particularly to a method for fabricating a flexible display and apparatus and production process thereof.

2. Description of the Related Art

Flexible displays have unique advantages such as high impact resistance, light weight and flexibility. As such, in addition to researched applications in newly emerging products such as electronic paper, electronic tags, credit cards, scrolling displays and electronic advertising boards, further applications are being explored for usages in portable electronic products. As for flat panel displays, developmental trends continue to encompass larger areas, lighter weights and thinner frames. For flexible displays, the main developmental trend is for efficient and economic use of a plastic substrate in place of a glass substrate.

The conventional flexible display fabrication process, using a plastic substrate, requires steps such as film deposition, photolithography and etching. Also, the apparatuses for manufacturing conventional flexible displays are expensive, and the costs for research and development in this field of technology as well as fabrication are high. Furthermore, the conventional flexible display fabrication process is not a continuous process, thus making it difficult to increase manufacturing yields. As a result, with high costs and high product prices, expanding further application of the conventional flexible displays have been hindered.

Thus, development of a novel method for fabricating a flexible display is desirable.

BRIEF SUMMARY OF THE INVENTION

One embodiment of the invention provides a method for fabricating a display comprising providing a substrate having a pixel area, forming a plurality of patterned first electrodes on the pixel area, forming a plurality of partitions on both sides of the patterned first electrodes, respectively filling in spaces between the partitions with various colored materials to cover the patterned first electrodes by a depositing process, and forming a cover on the partitions and the colored materials.

One embodiment of the invention provides an apparatus for producing a display comprising a cleaning system utilized to clean a substrate, a first electrode formation device adjacent to the cleaning system utilized to form a plurality of patterned first electrodes on the substrate, a first transfer tower adjacent to the first electrode formation device utilized to transfer the substrate with the patterned first electrodes along a first direction, a first printing device adjacent to the first transfer tower utilized to receive the substrate and form a plurality of partitions on both sides of the patterned first electrodes, a depositing device adjacent to the first printing device utilized to respectively fill various colored materials into spaces between the partitions, a second printing device or a second depositing device adjacent to the foregoing depositing device utilized to form a protective layer on the partitions and the colored materials, a second transfer tower adjacent to the second printing/depositing device utilized to transfer the substrate with the protective layer along a second direction, and a second electrode formation device adjacent to the second transfer tower utilized to receive the substrate and form a plurality of patterned second electrodes on the protective layer.

One embodiment of the invention provides a process for producing a display comprising utilizing a cleaning system to clean a substrate, utilizing a first electrode formation device to form a plurality of patterned first electrodes on the substrate, utilizing a first transfer tower to transfer the substrate with the patterned first electrodes, utilizing a first printing device to form a plurality of partitions on both sides of the patterned first electrodes, utilizing a depositing device to respectively fill various colored materials into spaces between the partitions, utilizing a second printing device or a second depositing device to form a protective layer on the partitions and the colored materials, utilizing a second transfer tower to transfer the substrate with the protective layer, and utilizing a second electrode formation device to form a plurality of patterned second electrodes on the protective layer.

A detailed description is given in the following embodiments with reference to the accompanying drawings.

BRIEF DESCRIPTION OF THE DRAWINGS

The invention can be more fully understood by reading the subsequent detailed description and examples with references made to the accompanying drawing, wherein.

DETAILED DESCRIPTION OF THE INVENTION

The following description is of the mode of carrying out the invention. This description is made for the purpose of illustrating the general principles of the invention and should not be taken in a limiting sense. The scope of the invention is determined by reference to the appended claims.

According to an embodiment of the invention, a method for fabricating a display is shown in FIGS. 1A-1E.

Figure 1A:
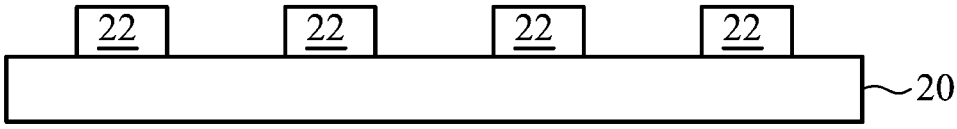
FIGS. 1A-1E show cross-sectional views of a method for fabricating a display according to an embodiment of the invention.

Referring to FIG. 1A, a substrate 20 is provided and a cleaning process is optionally performed to remove contaminants thereon. The substrate 20 may comprise transparent plastic materials, for example, polycarbonate (PC), polyethersulfone (PES), polyarylate (PAR), polynorbornene (PNB), polyimide (PI), polyethylene terephathalate (PET), polyetheretherketone (PEEK), polyethylenenaphthalate (PEN) or polyetherimide (PEI).

A plurality of patterned first electrodes 22 are formed on the substrate 20. In an embodiment, a transparent conductive material layer (not shown) is formed on the substrate 20 by a deposition process, for example, chemical vapor deposition (CVD). The transparent conductive material layer may comprise poly(3,4-ethylenedioxythiophene) (PEDOT). A patterned photoresist layer (not shown) is then formed on the transparent conductive material layer by a printing process to define subsequently formed first electrode areas. Next, the transparent conductive material layer uncovered by the patterned photoresist layer is removed by a conventional etching process to form the patterned first electrodes 22.

In an embodiment, a wet surface treatment process is performed on the substrate 20 to form a self-assembled membrane (SAM) thereon.

Figure 2:
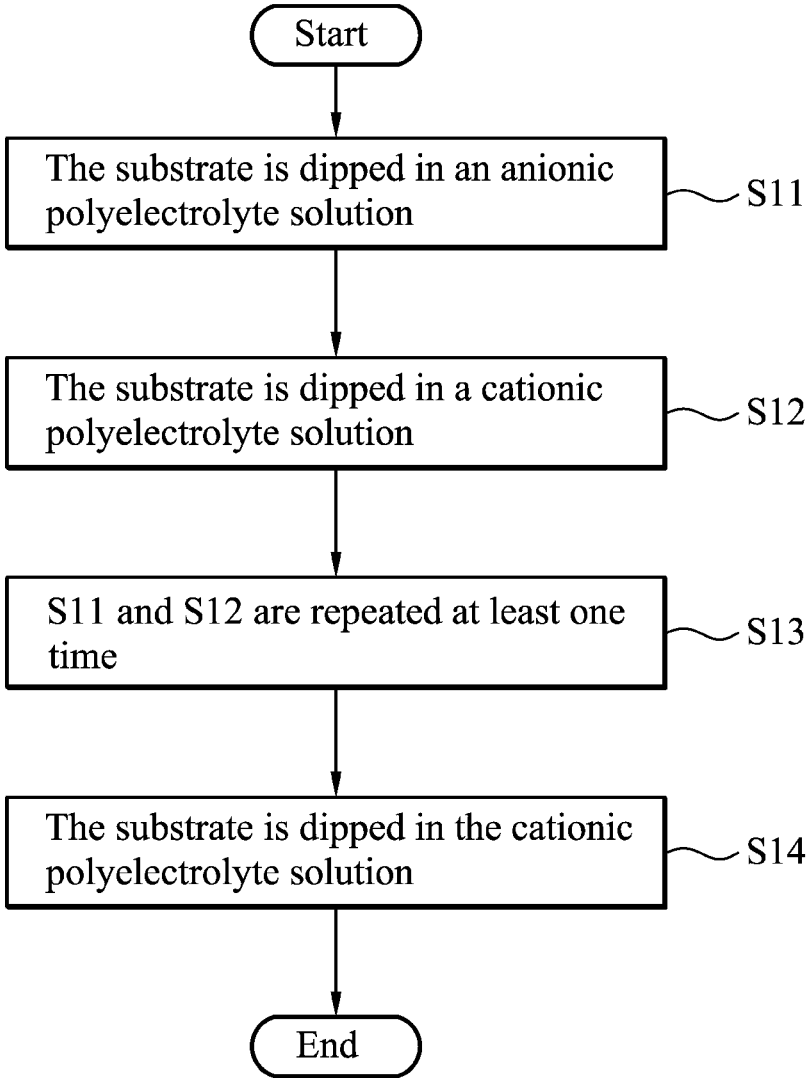
FIG. 2 shows a flow chart of a wet surface treatment process according to an embodiment of the invention.

Referring to FIG. 2, a flow chart of the wet surface treatment process is shown. The substrate 20 is dipped in an anionic polyelectrolyte solution (S11). The anionic polyelectrolyte solution may comprise polyacrylic acid (PAA), polymethacrylic acid (PMA), polystyrenesulfonate (PSS), poly (3-thiopheneacetic acid) (PTAA) or combinations thereof. Next, the substrate 20 is dipped in a cationic polyelectrolyte solution (S12). The cationic polyelectrolyte solution may comprise polyacrylamide hydrochloride (PAH), polyvinyl imidazole (PVI+), polyvinyl pyrrolidone (PVP+), polyacrylamide (PAAm), polyaniline (PAN) or combinations thereof.

In order to effectively alter the surface property of the substrate 20, S11 and S12 may be repeated to stack a plurality of bilayers composed of the anionic polyelectrolyte/cationic polyelectrolyte on the substrate 20 (S13). Next, the substrate 20 is dipped in the cationic polyelectrolyte solution to form a nano-level multi-layered self-assembled membrane on the surface of the substrate 20 (S14). In other embodiments, the nano-level multi-layered self-assembled membrane may also be formed by a printing, dispensing, dipping, or spray process or combinations thereof.

Next, a patterned catalyst material layer is formed on the multi-layered self-assembled membrane by a printing process, for example, ink-jet printing, laser printing, slot coating, imprinting, gravure printing or screen printing. After drying, an electroless plating process is performed to deposit a metal on the patterned catalyst material layer. The metal is reacted with the catalyst to form the patterned first electrodes 22.

After electroless plating, a conventional plating process may be performed to improve first electrode formation.

Figure 1B:
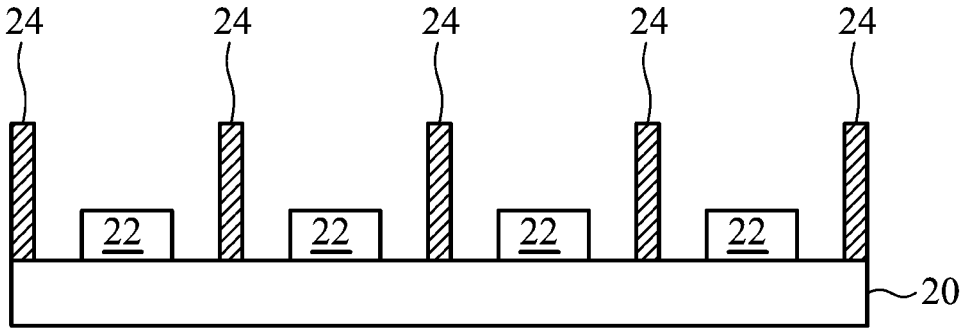

Referring to FIG. 1B, a plurality of partitions 24 are formed on both sides of the patterned first electrodes 22 by a printing process to isolate subsequently disposed various colored materials on the patterned first electrode 22. In an embodiment, the partitions 24 may contact the patterned first electrodes 22. The printing process may comprise ink-jet printing, laser printing, slot coating, imprinting, gravure printing or screen printing. Specifically, the steps of forming the patterned first electrode 22 and the partitions 24 may be inversed. In an embodiment, the partitions 24 may be solidified by a photo-curing or thermo-curing process.

Figure 1C:
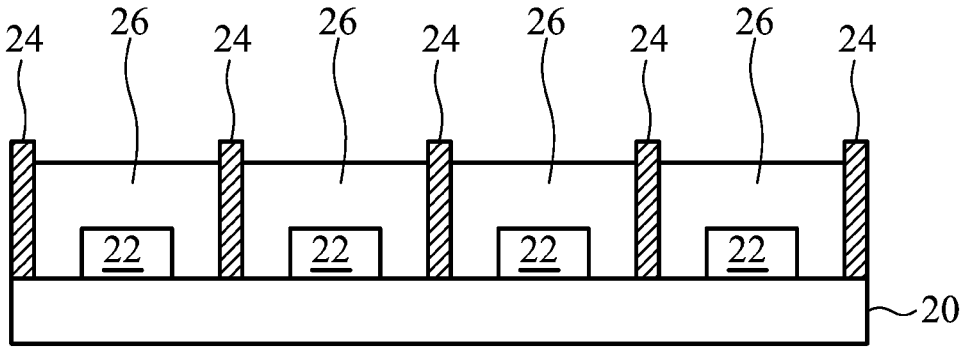

Referring to FIG. 1C, various colored materials 26 are respectively filled in spaces between the partitions 24 and cover the patterned first electrodes 22 by a depositing process. The colored materials 26 may comprise cholesterol liquid crystal or organic-phase color ink. The various colored materials are isolated one another by the partitions 24. In an embodiment, a surface treatment process, for example, UV ozone treatment, ion beam treatment or plasma treatment such as atmosphere plasma treatment is optionally performed on the patterned first electrode 22 and the partitions 24 before filling the colored materials 26.

Figure 1D:
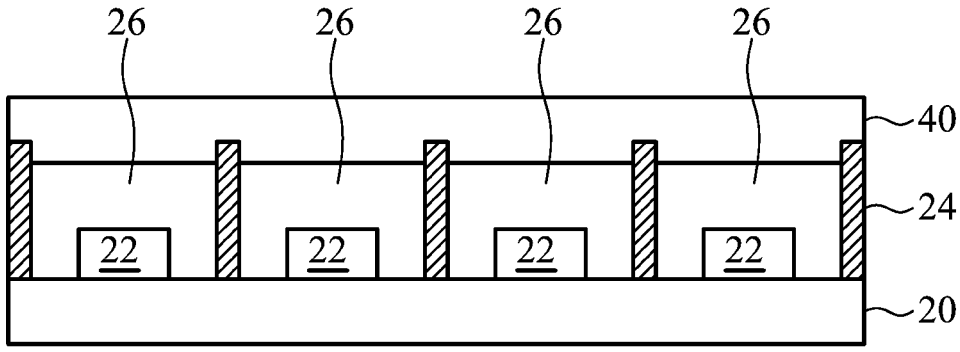

Referring to FIG. 1D, a protective layer 40, for example, a photosensitive cross-linkable material is formed on the partitions 24 and the colored materials 26 by a printing process to avoid blending of the various colored materials 26 and air entrance. The printing process may comprise ink-jet printing, laser printing, slot coating, imprinting, gravure printing or screen printing.

Figure 1E:
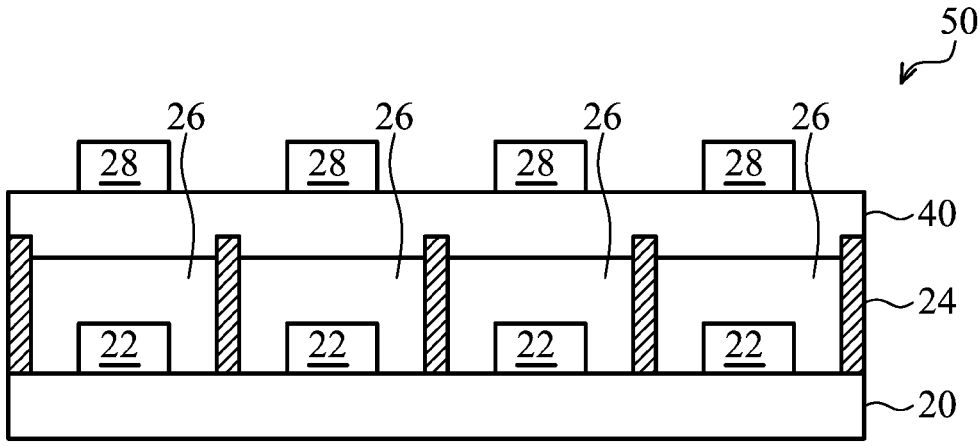

Referring to FIG. 1E, a plurality of patterned second electrodes 28 are formed on the protective layer 40, corresponding to the patterned first electrodes 22. The methods and materials for forming the patterned first electrode 22 and the patterned second electrodes 28 are similar. Thus, preparing a display 50 comprising the plastic substrate 20, the patterned first electrodes 22, the partitions 24, the colored materials 26, the protective layer 40 and the patterned second electrodes 28. The substrate 20 is further cut after the patterned second electrodes 28 have been formed.

According to an embodiment of the invention, a method for fabricating a display is shown in FIGS. 3A-3E.

Figure 3A:
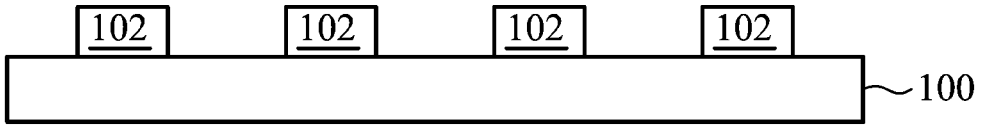
FIGS. 3A-3E show cross-sectional views of a method for fabricating a display according to an embodiment of the invention.

Referring to FIG. 3A, a first substrate 100 is provided and a cleaning process is optionally performed to remove contaminants thereon. The first substrate 100 may comprise transparent plastic materials, for example, polycarbonate (PC), polyethersulfone (PES), polyarylate (PAR), polynorbornene (PNB), polyimide (PI), polyethylene terephathalate (PET), polyetheretherketone (PEEK), polyethylenenaphthalate (PEN) or polyetherimide (PEI).

A plurality of patterned first electrodes 102 are formed on the first substrate 100. The methods and materials for forming the patterned first electrode 102 and 22 are similar.

Figure 3B:
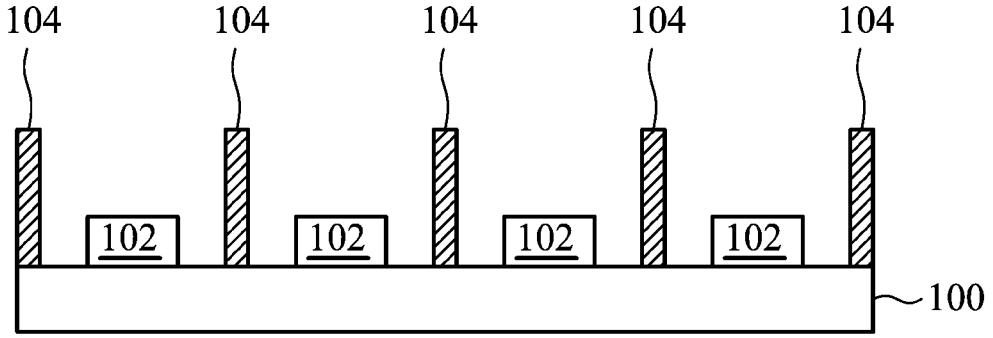

Referring to FIG. 3B, a plurality of partitions 104 are formed on both sides of the patterned first electrodes 102 by a printing process to isolate subsequently disposed various colored materials on the patterned first electrode 102. In an embodiment, the partitions 24 may contact the patterned first electrodes 22. The printing process may comprise ink-jet printing, laser printing, slot coating, imprinting, gravure printing or screen printing. Specifically, the steps of forming the patterned first electrode 102 and the partitions 104 may be inversed. In an embodiment, the partitions 104 may be solidified by a photo-curing or thermo-curing process.

Figure 3C:
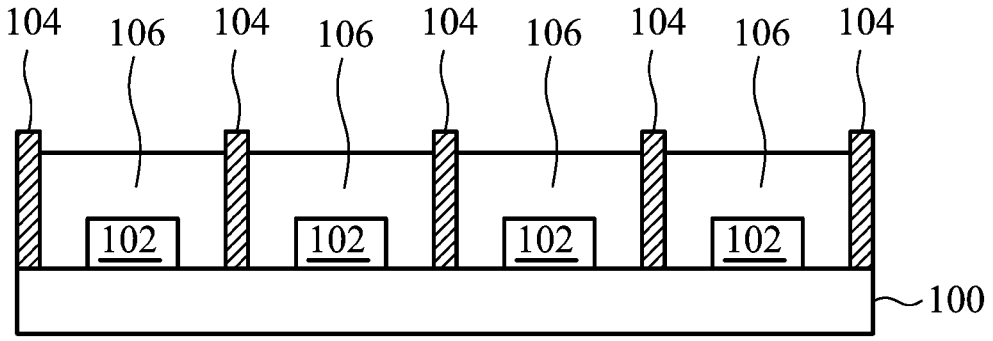

Referring to FIG. 3C, various colored materials 106 are respectively filled in spaces between the partitions 104 and cover the patterned first electrodes 102 by a depositing process. The colored materials 106 may have the same materials as the colored materials 26 shown in FIG. 1C.

Figure 3D:
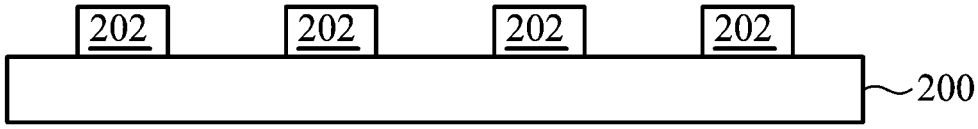

Referring to FIG. 3D, a second substrate 200 with a plurality of patterned second electrodes 202 formed thereon is provided. The materials of the second substrate 200 and the first substrate 100 may be the same. The methods and materials for forming the patterned second electrode 202 and the patterned first electrode 102 are similar.

Figure 3E:
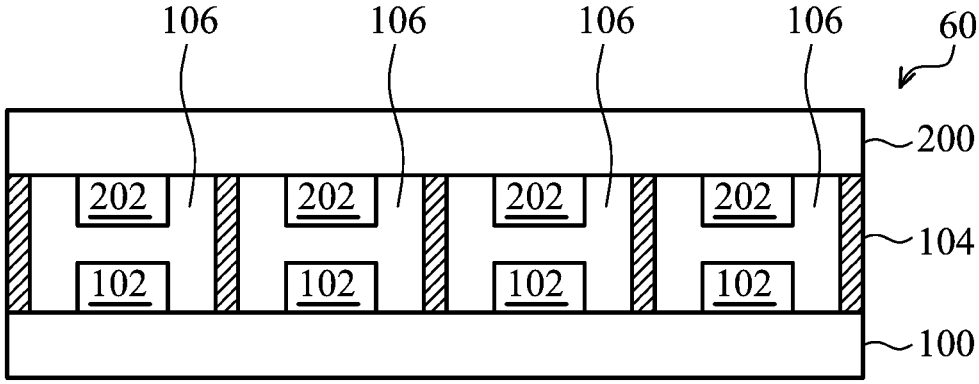

Referring to FIG. 3E, the second substrate 200 with the patterned second electrode 202 is reversed and applied to the first substrate 100. The patterned second electrodes 202 are opposite to the patterned first electrodes 102 and corresponded therewith. Thus, a display 60 comprising the first substrate 100, the patterned first electrodes 102, the partitions 104, the colored materials 106, the second substrate 200 and the patterned second electrodes 202 is prepared.

According to an embodiment of the invention, a method for fabricating a display is shown in FIGS. 4A-4E.

Figure 4A:
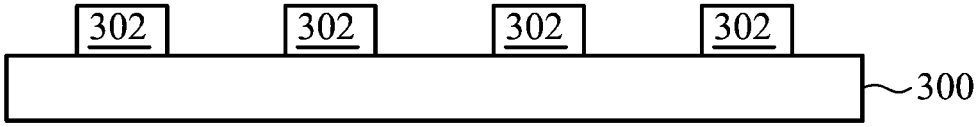
FIGS. 4A-4E show cross-sectional views of a method for fabricating a display according to an embodiment of the invention.

Referring to FIG. 4A, a first substrate 300 is provided and a cleaning process is optionally performed to remove contaminants thereon. The first substrate 300 may comprise transparent plastic materials, for example, polycarbonate (PC), polyethersulfone (PES), polyarylate (PAR), polynorbornene (PNB), polyimide (PI), polyethylene terephathalate (PET), polyetheretherketone (PEEK), polyethylenenaphthalate (PEN) or polyetherimide (PEI).

A plurality of patterned first electrodes 302 are formed on the first substrate 300. The methods and materials for forming the patterned first electrode 302 and the patterned first electrode 22 shown in FIG. 1A are similar.

Figure 4B:
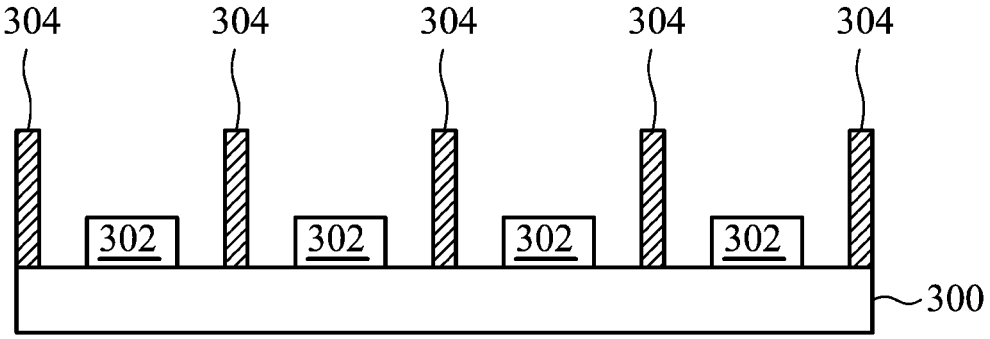

Referring to FIG. 4B, a plurality of partitions 304 are formed on both sides of the patterned first electrodes 302 by a printing process to isolate subsequently disposed various colored materials on the patterned first electrode 302. In an embodiment, the partitions 24 may contact the patterned first electrodes 22. The printing process may comprise ink-jet printing, laser printing, slot coating, imprinting, gravure printing or screen printing. Specifically, the steps of forming the patterned first electrode 302 and the partitions 304 may be inversed. In an embodiment, the partitions 304 may be solidified by a photo-curing or thermo-curing process.

Figure 4C:
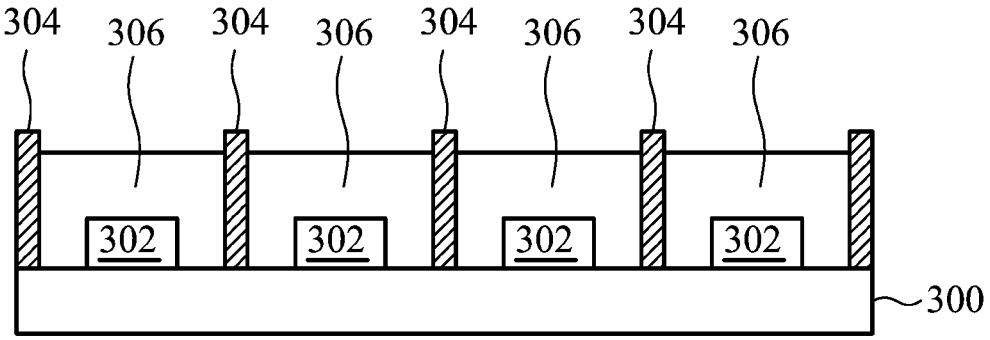

Referring to FIG. 4C, the various colored materials 306 are respectively filled in spaces between the partitions 304 and cover the patterned first electrodes 302 by a depositing process. The colored materials 306 may have the same materials as the colored materials 26 shown in FIG. 1C.

Figure 4D:
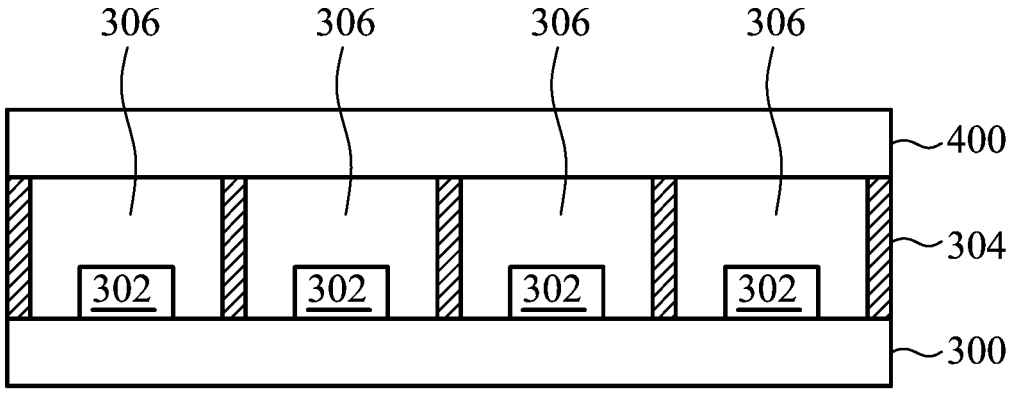

Referring to FIG. 4D, a second substrate 400 is provided to apply to the first substrate 300 with the colored materials 306 and the partitions 304 to avoid blending of the various colored materials 306. The materials of the second substrate 400 and the first substrate 300 may be the same.

Figure 4E:
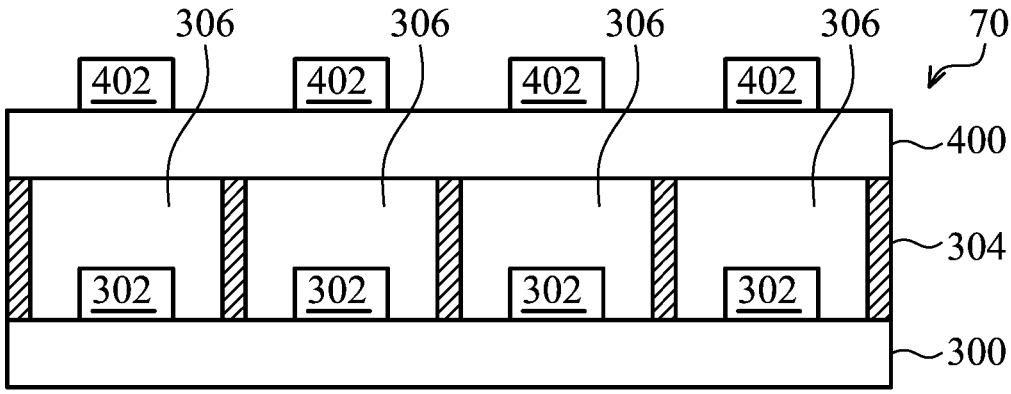

Referring to FIG. 4E, a plurality of patterned second electrodes 402 are formed on the second substrate 400. Thus, preparing a display 70 comprising the first substrate 300, the patterned first electrodes 302, the partitions 304, the colored materials 306, the second substrate 400 and the patterned second electrodes 402. The methods and materials for forming the patterned second electrode 402 and the patterned first electrode 302 are similar.

Figure 5:
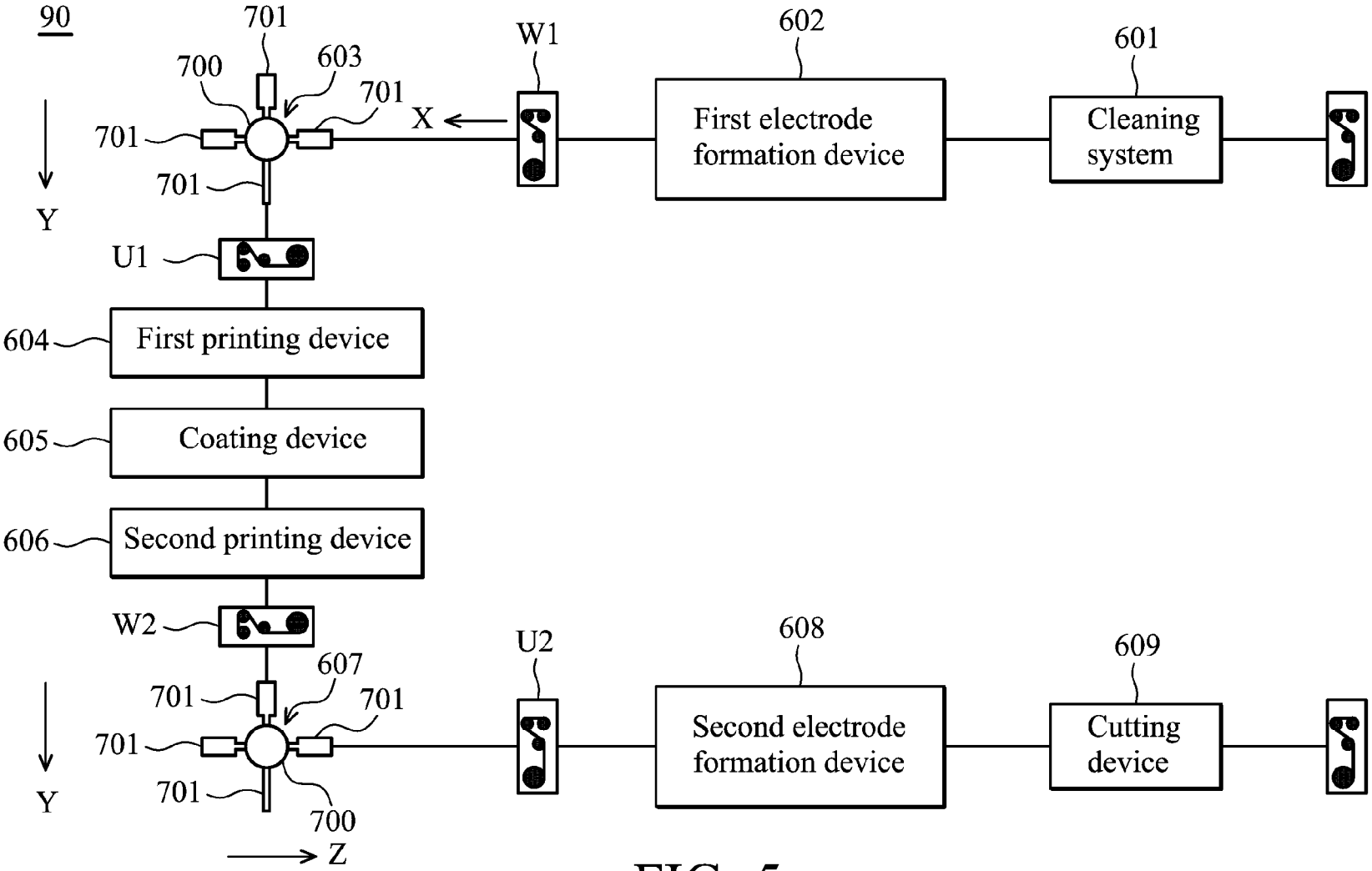
FIG. 5 shows an apparatus and production process of a flexible display according to an embodiment of the invention.

Referring to FIG. 5, an apparatus and production process 90 for a flexible display are shown, according to the method from FIG. 1A to FIG. 1E, but is not limited thereto. The apparatus comprises a cleaning system 601 utilized to clean a substrate 20, a first electrode formation device 602 utilized to form a plurality of patterned first electrodes 22 on the substrate 20, a first transfer tower 603 utilized to transfer the substrate 20 with the patterned first electrodes 22, a first printing device 604 utilized to form a plurality of partitions 24 on both sides of the patterned first electrodes 22, a depositing device 605 utilized to respectively fill various colored materials 26 in spaces between the partitions 24, a second printing device 606 utilized to form a protective layer 40 on the partitions 24 and the colored materials 26, a second transfer tower 607 utilized to transfer the substrate 20 with the protective layer 40, a second electrode formation device 608 utilized to receive the substrate 20 and form a plurality of patterned second electrodes 28 on the protective layer 40, and a cutting device 609, for example, wheel cutting device, die cutting device or laser cutting device utilized to cut the substrate 20 to a proper size. The first transfer tower 603 and the second transfer tower 607 respectively comprises an axis 700 and a plurality of reels 701 disposed on side walls of the axis 700. The one of the reels 701 of the first transfer tower 603 is inserted with the substrate 20 with the patterned first electrodes 22 and the axis 700 is rotated to move the reel 701 from a first direction X to a second direction Y to transfer the substrate 20 to the first printing device 604. The one of the reels 701 of the second transfer tower 607 is inserted with the substrate 20 with the protective layer 40 and the axis 700 is rotated to move the reel 701 from a third direction S to a fourth direction Z to transfer the substrate 20 to the second electrode formation device 608. The direction S and the second direction Y may be the same or not. The direction Z and the first direction X may be the same or not.

The first electrode formation device 602 or the second electrode formation device 608 may comprise a printing device, an etching system, a plating system, a plurality of reaction tanks or combinations thereof. The printing device may comprise an ink-jet printing apparatus, a laser printing apparatus, a slot coating apparatus, an imprinting apparatus, a gravure printing apparatus, a screen printing apparatus or combinations thereof. The first printing device 604 or the second printing device 606 may comprise an ink-jet printing apparatus, a laser printing apparatus, a slot coating apparatus, an imprinting apparatus, a gravure printing apparatus, a screen printing apparatus or combinations thereof.

The apparatus further comprises a first winding device W1 disposed between the first electrode formation device 602 and the first transfer tower 603 utilized to wind the substrate to form a winding substrate, a first unwinding device U1 disposed between the first transfer tower 603 and the first printing device 604 utilized to unwind the winding substrate to form a flat substrate, a second winding device W2 disposed between the second printing device 606 and the second transfer tower 607 utilized to wind the substrate to form a winding substrate, and the second unwinding device U2 disposed between the second transfer tower 607 and the second electrode formation device 608 utilized to unwind the winding substrate to form a flat substrate.

In an embodiment, the apparatus further comprises guiders (not shown) respectively disposed between the first transfer tower 603 and the first winding device W1 or between the first transfer tower 603 and the first unwinding device U1 and disposed between the second transfer tower 607 and the second winding device W2 or between the second transfer tower 607 and the second unwinding device U2 to direct the substrate 20 at the first transfer tower 603, the first winding device W1, the first unwinding device U1, the second transfer tower 607, the second winding device W2 or the second unwinding device U2 during winding and unwinding.

Additionally, the apparatus further comprises an unwinding device before the cleaning system 601 to unwind and transfer the substrate 20 to the cleaning system 601, and a receiving device behind the cutting device 609 to receive the display production.

In an embodiment, the fabrication method of a display is divided into three stages. The first stage comprises cleaning the substrate, treating the surface of the substrate, and patterning the first electrode formations. The second stage comprises forming a partition between the patterned first electrodes, filling colored materials between the partitions, and forming a protective layer on the partitions and the colored materials. The third stage comprises patterning a second electrode formation on the protective layer, and cutting the substrate. The three stages are distinct and separate from the windable substrate process. The invention, however, also provides a continuous process including the three stages.

In the invention, the display is fabricated under normal temperature and pressure, without a conventional photolithography process. Thus, substrate stress resulting from photolithography misalignment and high temperature can be avoided. Additionally, the transfer tower effectively improves production efficiency of the flexible display.

While the invention has been described by way of examples and in terms of embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An apparatus for producing a display, comprising:

a cleaning system configured to clean a substrate;

a first electrode formation device configured to form a plurality of patterned first electrodes on the substrate;

a first transfer tower configured to transfer the substrate with the patterned first electrodes;

a first printing device configured to form a plurality of partitions on both sides of the patterned first electrodes;

a depositing device configured to respectively fill various colored materials in spaces between the partitions after the partitions are printed on the both sides of the patterned first electrodes;

a second printing device configured to form a protective layer on the partitions and the colored materials;

a second transfer tower configured to transfer the substrate with the protective layer; and a second electrode formation device configured and arranged to form a plurality of patterned second electrodes on the protective layer after the protective layer is printed on the partitions and the colored materials.

2. The apparatus for producing a display as claimed in claim 1, wherein the partitions contact the patterned first electrodes.

3. The apparatus for producing a display as claimed in claim 1, wherein the first and second transfer towers respectively comprises an axis and a plurality of reels disposed on side walls of the axis.

4. The apparatus for producing a display as claimed in claim 3, wherein the first transfer tower is configured such that when the substrate with the patterned first electrodes is inserted in the one of the reels thereof, the axis is rotatable to move the reel from a first direction to a second direction to transfer the substrate to the first printing device.

5. The apparatus for producing a display as claimed in claim 3, wherein the second transfer tower is configured such that when the substrate with the protective layer and the colored materials is inserted in the one of the reels thereof, the axis is rotatable to move the reel from a third direction to a fourth direction to transfer the substrate to the second electrode formation device.

6. The apparatus for producing a display as claimed in claim 1, further comprising a first winding device and a first unwinding device, wherein the first winding device is disposed between the first electrode formation device and the first transfer tower utilized to wind the substrate to form a winding substrate, and the first unwinding device is disposed between the first transfer tower and the first printing device utilized to unwind the wining substrate to form a flat substrate.

7. The apparatus for producing a display as claimed in claim 1, further comprising a second winding device and a second unwinding device, wherein the second winding device is disposed between the second printing device and the second transfer tower utilized to wind the substrate to form a winding substrate, and the second unwinding device is disposed between the second transfer tower and the second electrode formation device utilized to unwind the wining substrate to form a flat substrate.

8. The apparatus for producing a display as claimed in claim 6, further comprising a guider disposed between the first transfer tower and the first winding device or between the first transfer tower and the first unwinding device.

9. The apparatus for producing a display as claimed in claim 7, further comprising a guider disposed between the second transfer tower and the second winding device or between the second transfer tower and the second unwinding device.

10. The apparatus for producing a display as claimed in claim 1, wherein the first electrode formation device or the second electrode formation device comprises a third printing device, an etching system, a plating system, a plurality of reaction tanks or combinations thereof.

11. The apparatus for producing a display as claimed in claim 10, wherein the third printing device comprises an ink-jet printing apparatus, a laser printing apparatus, a slot coating apparatus, an imprinting apparatus, a gravure printing apparatus, a screen printing apparatus or combinations thereof.

12. The apparatus for producing a display as claimed in claim 1, wherein the first printing device or the second printing device comprises an ink-jet printing apparatus, a laser printing apparatus, a slot coating apparatus, an imprinting apparatus, a gravure printing apparatus, a screen printing apparatus or combinations thereof.

13. The apparatus for producing a display as claimed in claim 1, further comprising a cutting device disposed behind the second electrode formation device utilized to cut the substrate.

14. The apparatus for producing a display as claimed in claim 13, wherein the cutting device comprises wheel cutting device, die cutting device or laser cutting device.

* * * * *